US008104917B2

(12) United States Patent
Link

(10) Patent No.: US 8,104,917 B2
(45) Date of Patent: Jan. 31, 2012

(54) LED CURTAIN

(75) Inventor: Uu Link, Taipei County (TW)

(73) Assignee: Loading Technologies Co., Ltd., Sijhih (TW)

( * ) Notice: Subject to any disclaimer, the term of this patent is extended or adjusted under 35 U.S.C. 154(b) by 279 days.

(21) Appl. No.: 12/588,776

(22) Filed: Oct. 28, 2009

(65) Prior Publication Data

US 2010/0134025 A1 Jun. 3, 2010

(30) Foreign Application Priority Data

Dec. 2, 2008 (TW) ..... 97221550 U

(51) Int. Cl.
*F21V 21/00* (2006.01)

(52) U.S. Cl. ..... 362/217.01; 362/222; 362/249.06; 362/800; 315/185 R; 315/294; 315/312; 345/4; 345/82; 345/426; 345/905; 40/737

(58) Field of Classification Search ..... 315/185 R, 315/185 S, 294, 297, 307, 312; 362/217.01, 362/219, 222, 223, 249.04, 249.09, 249.06, 362/800; 345/4, 82, 903, 905, 582, 426, 345/204, 205; 40/729, 737
See application file for complete search history.

(56) References Cited

U.S. PATENT DOCUMENTS

| | | | | |
|---|---|---|---|---|
| 5,066,085 | A * | 11/1991 | Gimbutas et al. | 385/115 |
| 6,362,801 | B1 * | 3/2002 | Yuhara | 345/82 |
| 6,677,918 | B2 * | 1/2004 | Yuhara et al. | 345/1.3 |
| 6,997,591 | B2 * | 2/2006 | Krumholz | 362/543 |
| 7,336,874 | B2 * | 2/2008 | Miki | 385/115 |
| 7,852,285 | B2 * | 12/2010 | Tennagels | 345/1.3 |

* cited by examiner

*Primary Examiner* — Haiss Philogene
(74) *Attorney, Agent, or Firm* — Bacon & Thomas, PLLC

(57) ABSTRACT

An LED curtain includes a plurality of transparent hollow tubes parallelly connected side by side to form an integral unit and serve as a basic curtain body; a plurality of light-emitting strings, each of which includes a plurality of serially connected light-emitting diodes (LEDs) sequentially disposed in each of the hollow tubes; and a light controller internally provided with a circuit board, from which a plurality of signal lines is extended to separately connect to the light-emitting strings. Multiple pieces of the LED curtain can be hung to a track via a plurality of hooks provided at upper ends of the light-emitting strings. By operating the light controller to control the LEDs, different patterns or animations can be displayed on the curtain via the light-emitting strings, and different brightness of LEDs can be regulated to illuminate a room or create a special atmosphere.

6 Claims, 5 Drawing Sheets

LED CURTAIN

FIELD OF THE INVENTION

The present invention relates to a curtain, and more particularly to an LED curtain that includes a plurality of integrally injection molded transparent hollow tubes each having a LED string disposed therein. The LED strings can be controlled via a light controller to display different patterns and animations or to provide different brightness, allowing the LED curtain to serve as a display screen and create different atmospheres in a room. Since LEDs emit cold light having high brightness and consumes low power, the LED curtain can also be used as a lighting fixture.

BACKGROUND OF THE INVENTION

Currently, most curtains are made of woven fabrics showing different colors and patterns, so as to provide the functions of blocking out sunlight and interior decoration at the same time. However, in the night time, the conventional curtains do not provide any function of illuminating a room or showing different lighting effects to create different atmospheres in the room.

As it is known, light-emitting diodes (LEDs) has the advantages of high lighting efficiency, fast response time, long service life, damage-resistance, low power consumption, free of mercury and being environment-friendly, compactness, applicable to low-temperature environment, directional light source, and low light pollution. Therefore, LEDs have gradually replaced conventional indoor lamps. Currently, most of the LED products are applied to indicating devices, such as signboards, traffic lights, and indicating screens that are expensive and usually designed for commercial purpose. And, LED products for illumination are mainly used outdoors and have never been associated with a curtain for use.

It is therefore tried by the inventor to develop an LED curtain that combines the functions and advantages of a curtain and LEDs to serve not only as a curtain but also a display screen for showing different patterns and animations and a lighting fixture for illuminating a room.

SUMMARY OF THE INVENTION

A primary object of the present invention is to provide an LED curtain that combines the advantages of an LED and a curtain to serve as a curtain, a display screen and a lighting fixture at the same.

To achieve the above and other objects, the LED curtain according to the present invention includes a plurality of transparent hollow tubes integrally formed to be parallelly arrayed side by side for serving as a basic body of the curtain; a plurality of light-emitting strings, each of which includes a plurality of serially connected light-emitting diodes (LEDs) sequentially disposed in each of the hollow tubes; and a light controller internally provided with a circuit board, from which a plurality of signal lines is extended to separately connect to the light-emitting strings. Multiple pieces of the LED curtains can be hung to a track via a plurality of hooks provided at upper ends of the light-emitting strings. By operating the light controller, different patterns or animations can be displayed on the curtain via the light-emitting strings, and different brightness can be regulated to illuminate a room and create different atmospheres.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Please refer to FIGS. 1 to 5, in which an LED curtain according to a preferred embodiment of the present invention is shown. As shown, the LED curtain includes a plurality of transparent hollow tubes 12, a plurality of light-emitting strings 10, and a light controller 20.

Figure 1:
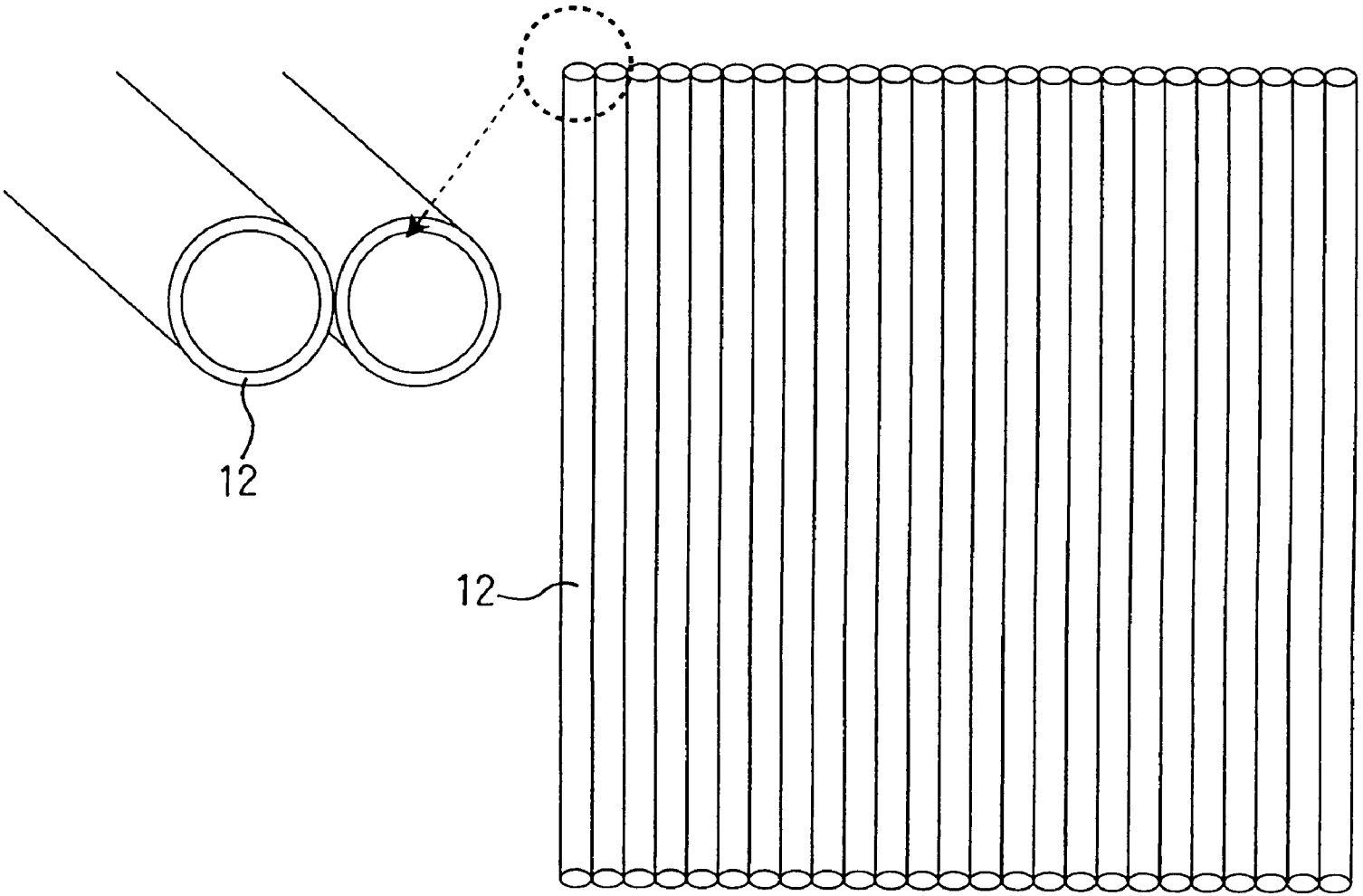
FIG. 1 is a perspective view of a set of integrally molded transparent hollow tubes for forming an LED curtain of the present invention.

The transparent hollow tubes 12 are made of a clear, highly heat-resistant and flexible polyvinyl chloride (PVC) plastic material through injection molding, so that the transparent hollow tubes 12 are connected to one another side by side to form an integral unit, as shown in FIG. 1. The integrally formed transparent hollow tubes 12 serve as a basic body of the LED curtain. Each of the transparent hollow tubes 12 internally defines a hollow space and provides good transparency, thermal insulation, and cooling effect.

Figure 2:
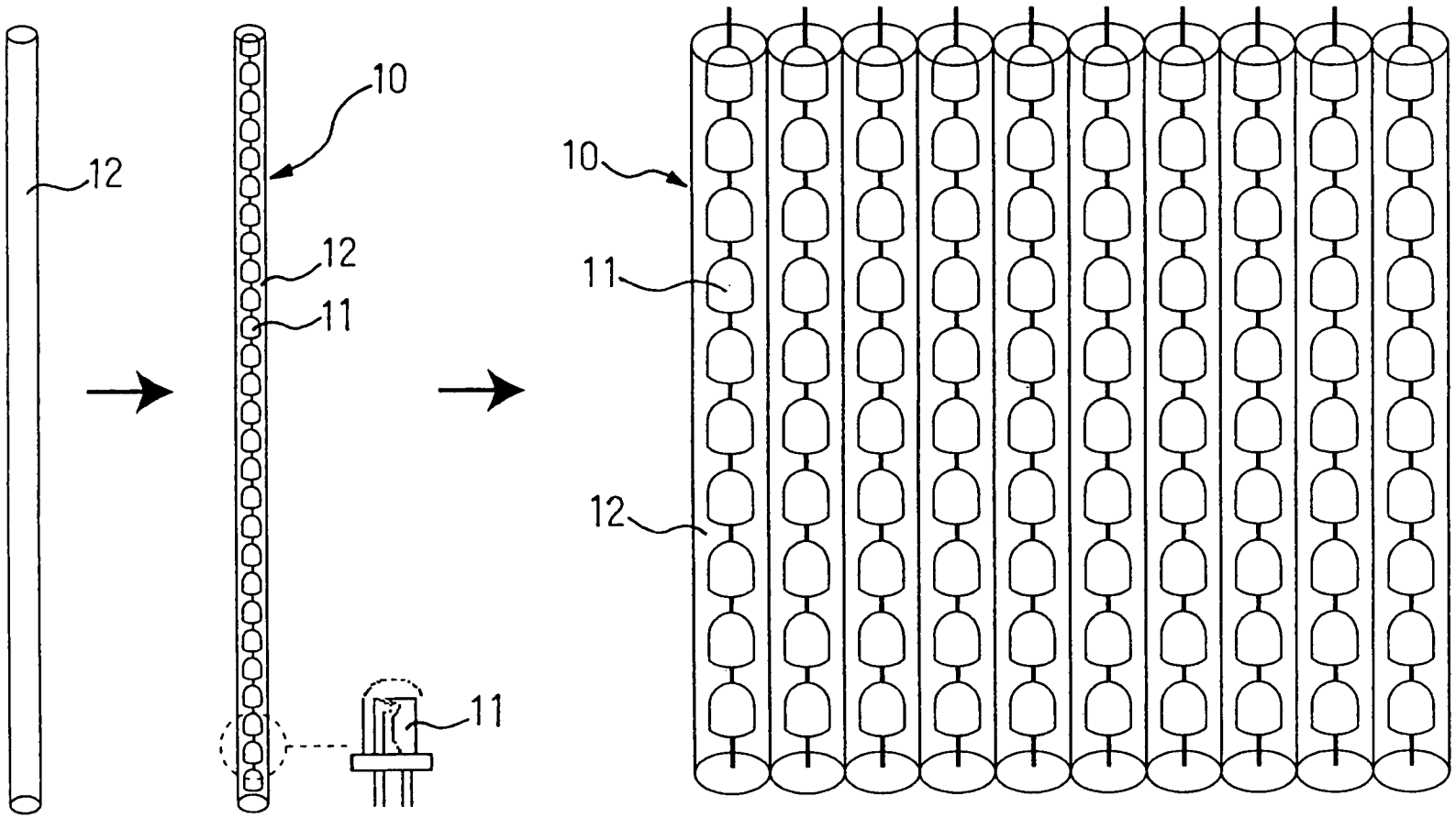
FIG. 2 shows the forming of light-emitting strings for the LED curtain of the present invention.

The light-emitting strings 10 are separately disposed in each of the transparent hollow tubes 12. Each of the light-emitting strings 10 includes a plurality of serially connected LEDs 11. The light-emitting strings 10 are sequentially positioned into the hollow spaces of the transparent hollow tubes 12, such that the serially connected LEDs 11 are arrayed in the transparent hollow tubes 12 to form a matrix. Preferably, the LEDs 11 are arrayed at a density of 100 LEDs 11 per 10 square centimeters (100 LEDs/10 $cm^2$), as shown in FIG. 2. With the advantages of high lighting efficiency, fast response time, long service life, damage-resistance, low power consumption, free of mercury and being environment-friendly, compactness, applicable to low-temperature environment, directional light source, and low light pollution, the LEDs 11 can replace conventional indoor lamps to serve as a lighting fixture.

Figure 3:
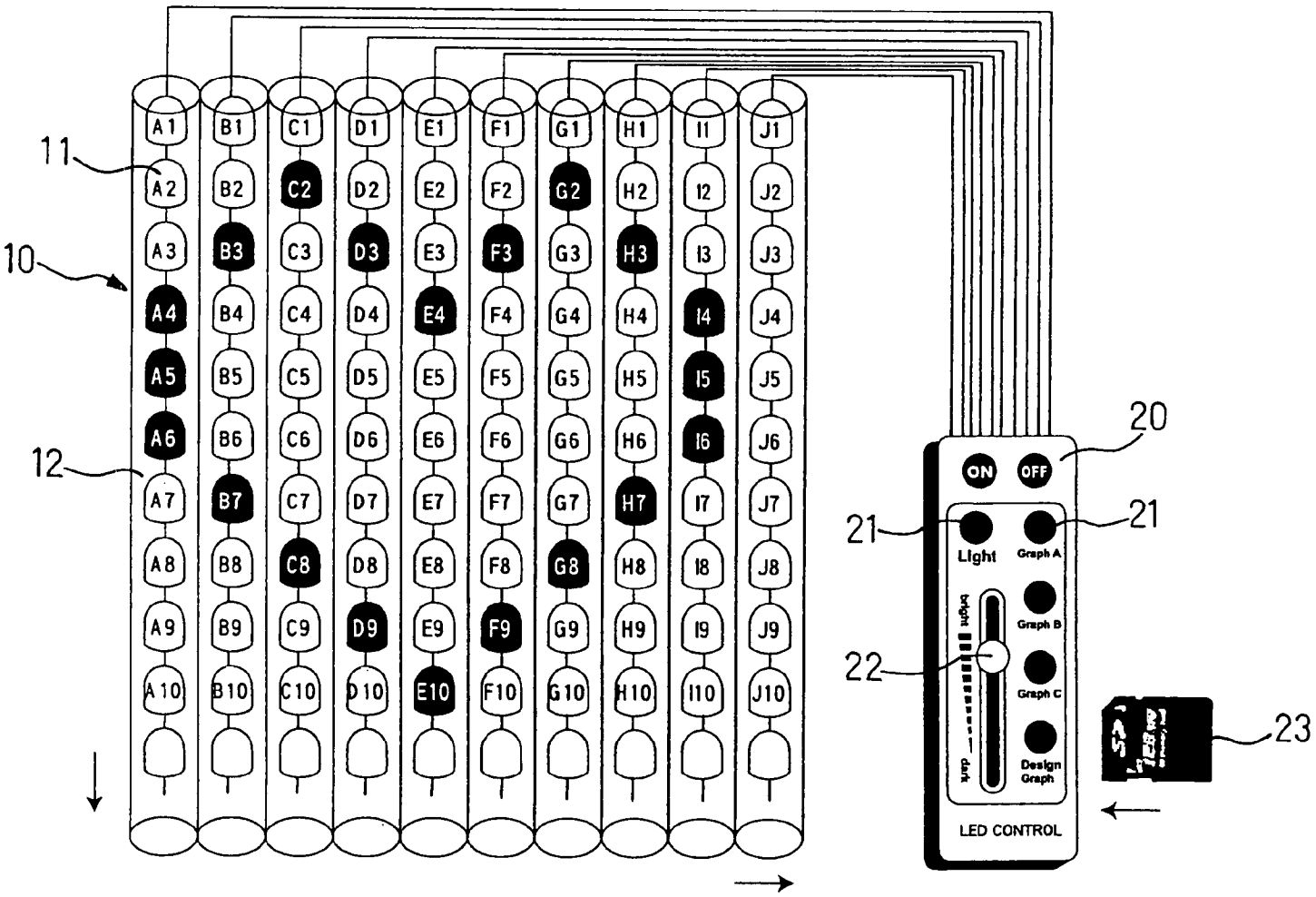
FIG. 3 is a conceptual view showing the connection of a light controller to the light-emitting strings of the LED curtain of the present invention.

Please refer to FIG. 3. The light controller 20 can be electrically connected to the plurality of light-emitting strings 10. The light controller 20 internally includes a circuit board (not shown). Signal lines extended from the circuit board each are connected to a specific one of the light-emitting strings 10. The light controller 20 is also provided with a plurality of pushbuttons 21 and an adjusting key 22. The pushbuttons 21 provide different functions, such as turning on or off the light-emitting strings 10, selecting a pattern to be displayed on the LED curtain via the light-emitting strings 10, and the like. The adjusting key 22 allows a user to adjust the brightness of the light-emitting strings 10. The light controller 20 is also provided with a memory card slot, via which a memory card 23 can be plugged onto the light controller 20. A user can design personal favorite patterns for displaying on the LED curtain and saves encoded programs containing the user-designed patterns in the memory card 23. When the memory card 23 is plugged onto the light controller 20 and the light controller 20 is powered on, signals can be sent from the light controller 20 to control the LEDs 11 on the light-emitting strings 10 to show the user-designed patterns, such as a heart, a star, or other symbols.

Figure 4:
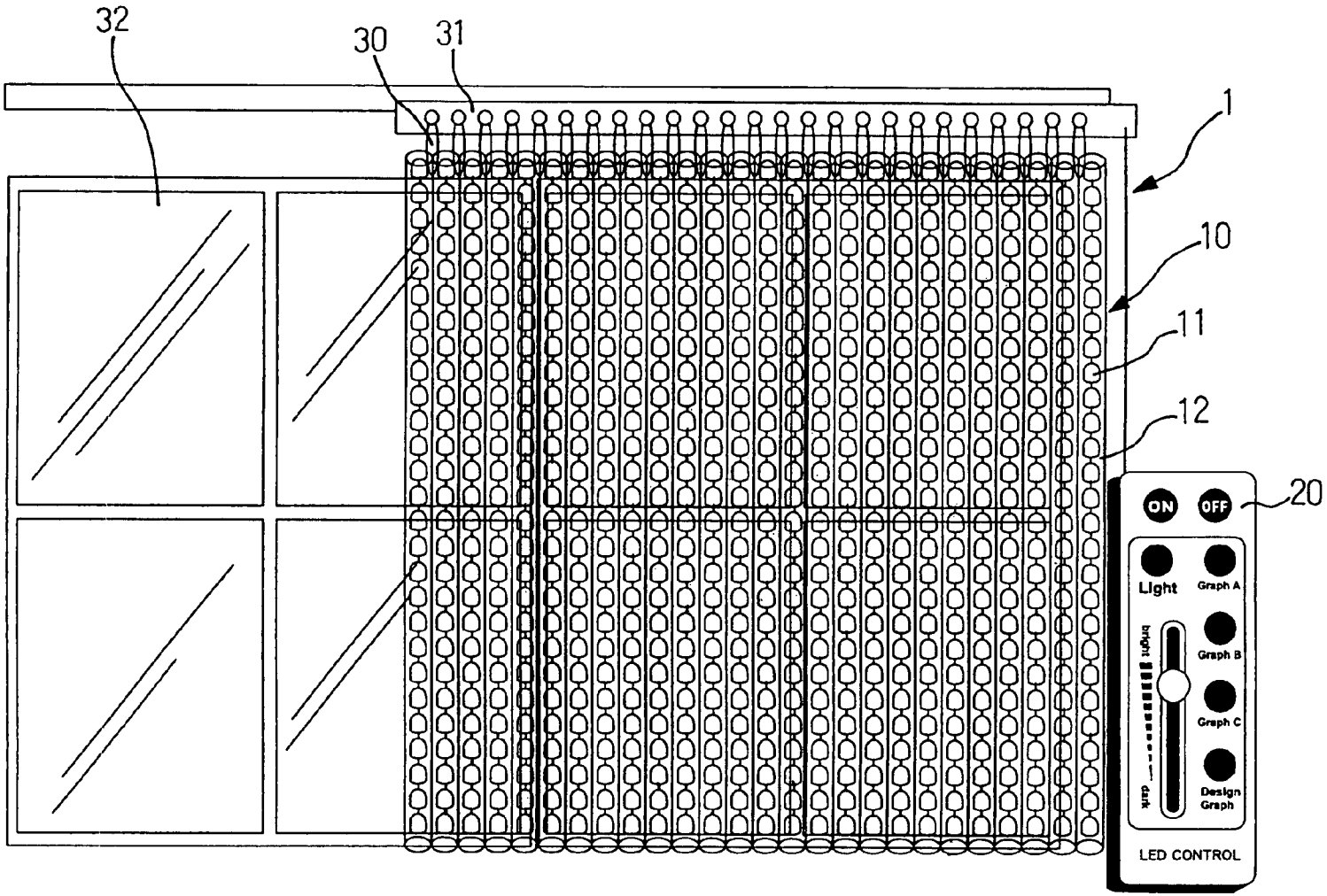
FIG. 4 shows the LED curtain of the present invention in a fully stretched state for use.
Figure 5:
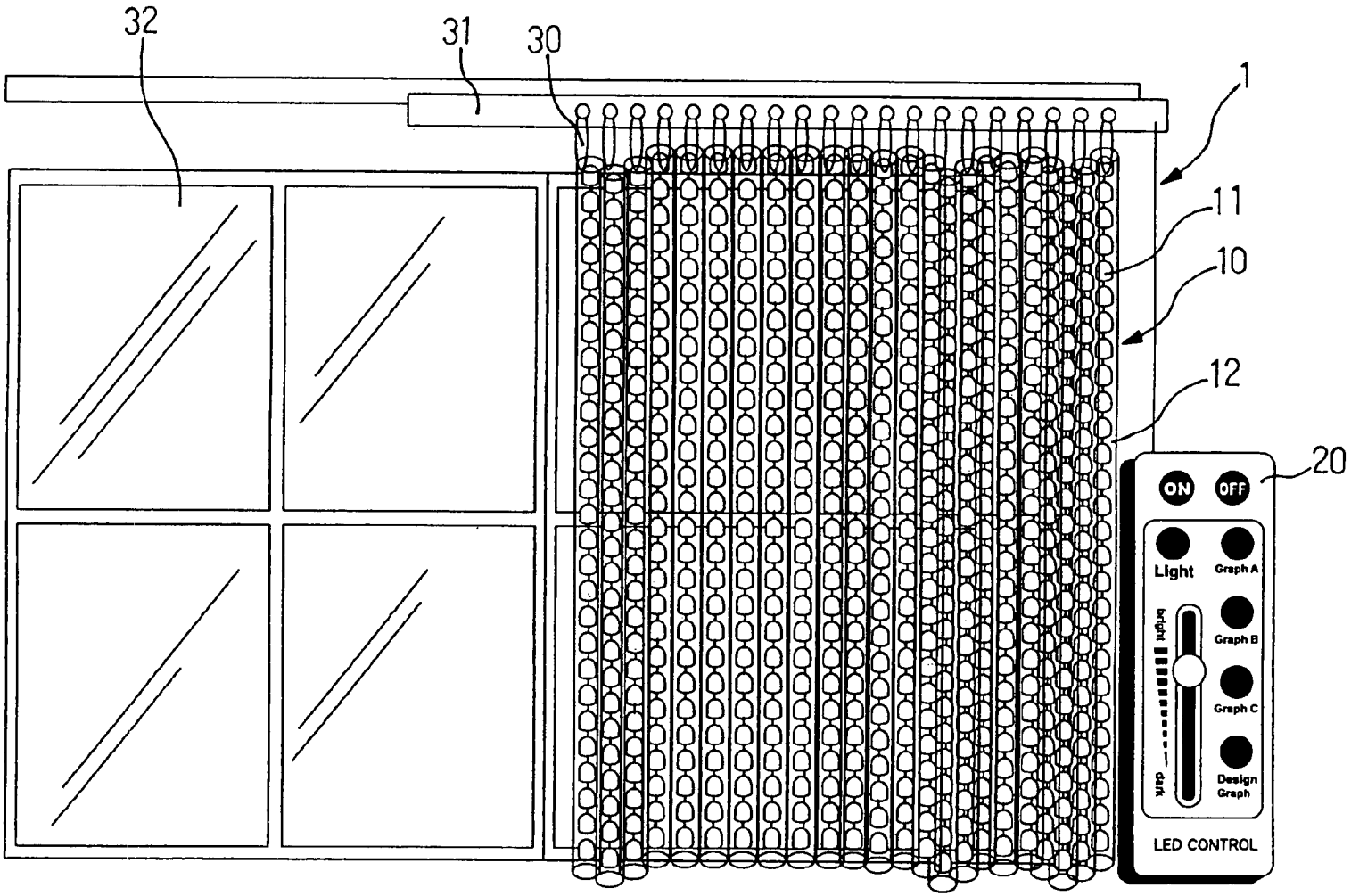
FIG. 5 shows the LED curtain of the present invention in a withdrawn state.

In practical use of the LED curtain of the present invention, hooks 30 can be connected to upper ends of the light-emitting strings 10. FIG. 4 shows an LED curtain 1 according to an embodiment of the present invention, which includes plural units of the transparent hollow tubes 12 with the light-emitting strings 10 positioned therein. These units of transparent hollow tubes 12 and light-emitting strings 10 are parallelly arranged and hung from a track 31 via the hooks 30. The LED curtain 1 can be installed in front of a glass window 32 in a residential house or an office. When the transparent hollow tubes 12 of the LED curtain 1 are in a fully stretched state as shown in FIG. 4, the light controller 20 can be powered on to send a carrier signal to the serially connected LEDs 11 of the light-emitting strings 10. Since the position of each of the LEDs 11 corresponds to one unique array code in the circuit board, the carrier signal sent by the light controller 20 can control the light-emitting strings 10 to display characters, patterns, or animations, or to adjust to different brightness. Therefore, the LED curtain 1 can also be used as a display screen for showing patterns or animations or a lighting fixture for illuminating a room. The LED curtain 1 can also be withdrawn to show the window 32 and admit natural light to a room, as shown in FIG. 5.

With the above arrangements, LEDs are directly disposed in transparent plastic hollow tubes to form an LED curtain. The LED curtain combines the advantageous features of a curtain and an LED to provide multiple functions, including illuminating, creating special atmospheres, indicating messages, shielding sight, screening sunlight, etc. By operating the light controller to control the on/off and the brightness of the LEDs, different patterns, animations, and other indicating symbols can be shown on the LED curtain, or different atmospheres can be created for a room. For instance, a scene of a snowing night or a Santa Claus streaking across the window can be shown on the LED curtain 1 on Christmas Eve; a birthday card can be shown on the LED curtain 1 in a house on a family member's birthday; or some messages, such as a special discount offered, can be displayed on the LED curtain 1 in a show window of a shop without the need of providing additional signboards or LED lamps.

The LED curtain of the present invention can also be directly applied to room illumination. The LEDs can replace conventional lamps to save about 89% of power consumption, compared to conventional lamps with the same brightness. Moreover, the brightness of the LED curtain can be conveniently regulated via the light controller.

The present invention has been described with a preferred embodiment thereof and it is understood that many changes and modifications in the described embodiment can be carried out without departing from the scope and the spirit of the invention that is intended to be limited only by the appended claims.

What is claimed is:

1. An LED curtain, comprising:

a plurality of transparent hollow tubes being formed into an integral unit through injection molding, the transparent hollow tubes being parallelly arrayed side by side to provide a basic body for the curtain; and each of the transparent hollow tubes internally defining a hollow space;

a plurality of light-emitting strings, each of which includes a plurality of light emitting diodes (LEDs), and the light-emitting strings being separately disposed in the hollow spaces of the transparent hollow tubes; and a light controller being internally provided with a circuit board, from which a plurality of signal lines are extended to separately connect to the light-emitting strings;

whereby the transparent hollow tubes with the light-emitting strings disposed therein form a curtain electrically connected to the light controller, and the LEDs are controlled via the light controller to show different patterns and animations on the curtain or to illuminate a room.

2. The LED curtain as claimed in claim 1, wherein the transparent hollow tubes are made of a clear, highly heat-resistant and flexible PVC plastic material through injection molding.

3. The LED curtain as claimed in claim 1, further comprising a plurality of hooks connected to upper ends of the light-emitting strings for hanging the curtain to a track.

4. The LED curtain as claimed in claim 1, wherein the light controller is provided with a plurality of pushbuttons and an adjusting key; the pushbuttons providing different functions for turning on/off the light-emitting strings, selecting a pattern to be shown on the curtain via the light-emitting strings, etc.; and the adjusting key allowing a user to adjust the light-emitting strings to different brightness.

5. The LED curtain as claimed in claim 1, wherein the LEDs in each of the light-emitting strings are serially connected, and a position of each of the LEDs corresponds to an array code in the circuit board of the light controller, whereby the LEDs on the light-emitting strings are separately controlled by a carrier signal sent from the light controller to be on or off to thereby display different characters, patterns or animations, or to provide different brightness.

6. The LED curtain as claimed in claim 1, wherein the light controller is provided with a memory card slot, via which a user can plug a memory card onto the light controller; whereby encoded programs containing user-designed patterns are saved in the memory card and the user-designed patterns are displayed on the curtain via the light-emitting strings when the memory card is plugged onto the light controller and the light controller is powered on.

* * * * *